United States Patent [19]

Aono

[11] 4,027,637

[45] June 7, 1977

[54] AIR-FUEL RATIO CONTROL SYSTEM FOR USE WITH INTERNAL COMBUSTION ENGINE

[75] Inventor: Shigeo Aono, Tokyo, Japan

[73] Assignee: Nissan Motor Co., Ltd., Yokohama, Japan

[22] Filed: Nov. 11, 1975

[21] Appl. No.: 630,851

[30] Foreign Application Priority Data

Nov. 14, 1974 Japan ..... 49-131345
Mar. 7, 1975 Japan ..... 50-26961

[52] U.S. Cl. ..... 123/119 D; 123/32 EE; 123/119 EC; 60/285 T; 261/DIG. 74

[51] Int. Cl.² ..... F01N 3/00

[58] Field of Search .... 123/32 EA, 119 D, 119 DB, 123/119 R, 26, 32 EE, 119 EC, 124 B; 60/285; 261/DIG. 74

[56] References Cited

UNITED STATES PATENTS

| | | | |
|---|---|---|---|
| 3,820,517 | 6/1974 | Nambu | 123/32 EA |
| 3,831,563 | 8/1974 | Brittian | 123/32 EA |
| 3,861,366 | 1/1975 | Masaki et al. | 123/32 EA |
| 3,895,611 | 7/1975 | Endo et al. | 123/32 EA |
| 3,909,601 | 9/1975 | Yamawaki et al. | 123/32 EA |
| 3,911,884 | 10/1975 | Moriya et al. | 123/32 EA |
| 3,921,612 | 11/1975 | Aono | 123/32 EA |

*Primary Examiner*—C. J. Husar
*Assistant Examiner*—Paul Devinsky
*Attorney, Agent, or Firm*—Frank J. Jordan

[57] ABSTRACT

Fuel injectors or a carburetor is electronically controlled to alternately deliver optimally rich and lean air-fuel mixtures to each combustion chambers.

9 Claims, 11 Drawing Figures

AIR-FUEL RATIO CONTROL SYSTEM FOR USE WITH INTERNAL COMBUSTION ENGINE

Figure 1:
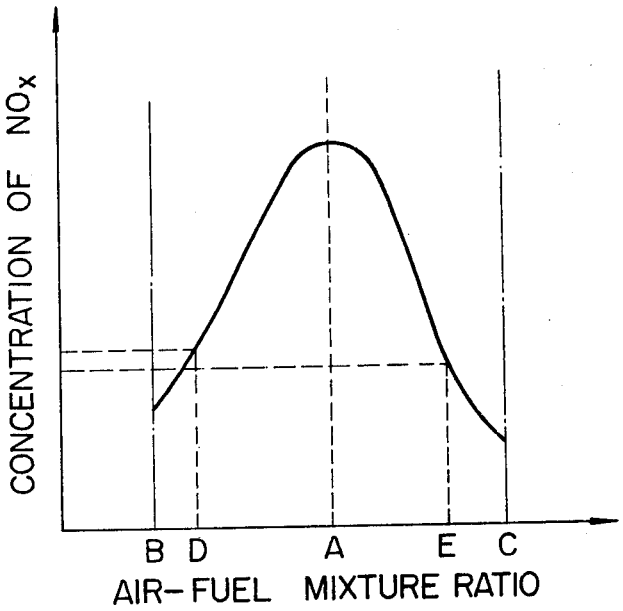

The present invention relates generally to an air-fuel ratio control system for use with an internal combustion engine, and particularly to an air-fuel ratio control system for use with an internal combustion engine in order to effectively reduce oxides of nitrogen contained in exhaust gases from the engine.

As is well known, concentration of oxides of nitrogen in engine exhaust gases has a peak value in the vicinity of stoichiometric air-fuel ratio and has a lower value at the air-fuel ratio of the air-fuel mixture richer or leaner than stoichiometry. Therefore, there has been prepared an air-fuel ratio control system for effectively reducing oxides of nitrogen on the basis of the above-mentioned concept. In accordance with the prior art control system, a rich air-fuel mixture is supplied to a predetermined group of combustion chambers, and on the other hand, a lean air-fuel mixture is supplied to the other predetermined group of combustion chambers. However, there are encountered some drawbacks in the prior art system. That is, since each group of combustion chambers is always supplied with either rich or lean air-fuel mixture, varying rates of carbonization occurs in the associated exhaust manifolds and spark plugs, etc. As a result, durability of the cylinder and the spark plugs etc. is undesirably different. Furthermore miss firings due to carbonized spark plugs is inevitable.

An object of the present invention is therefore to provide an improved air-fuel control system which alternatively supplies a rich and a lean air-fuel mixture to each group of combustion chambers to obviate the aforementioned difficulties inherent in the prior art system.

Figure 3:
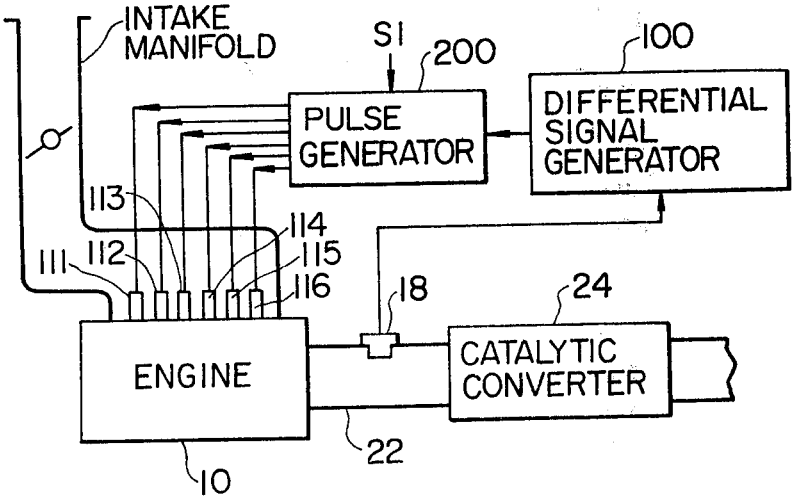
Figure 2A:
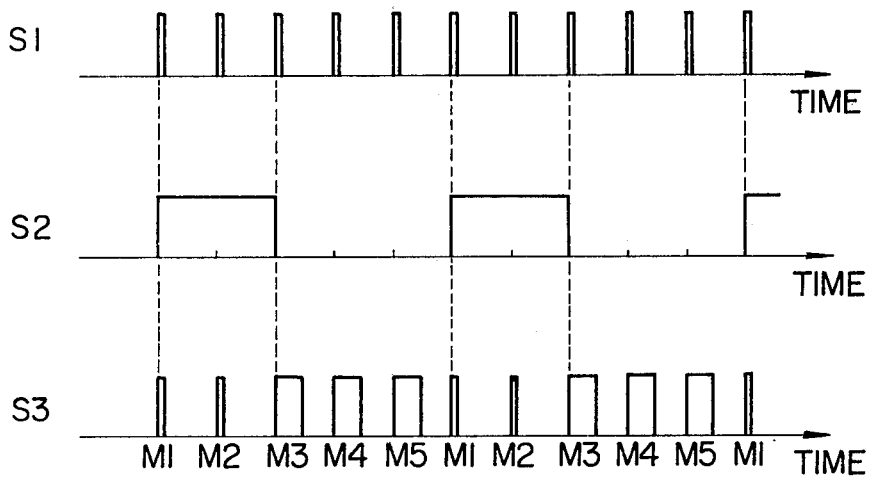
Figure 2B:
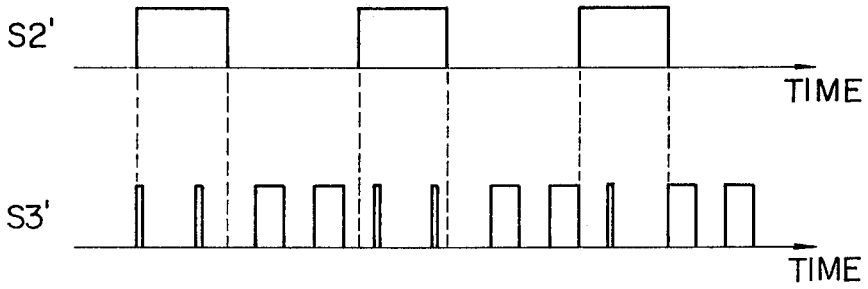
Figure 4:
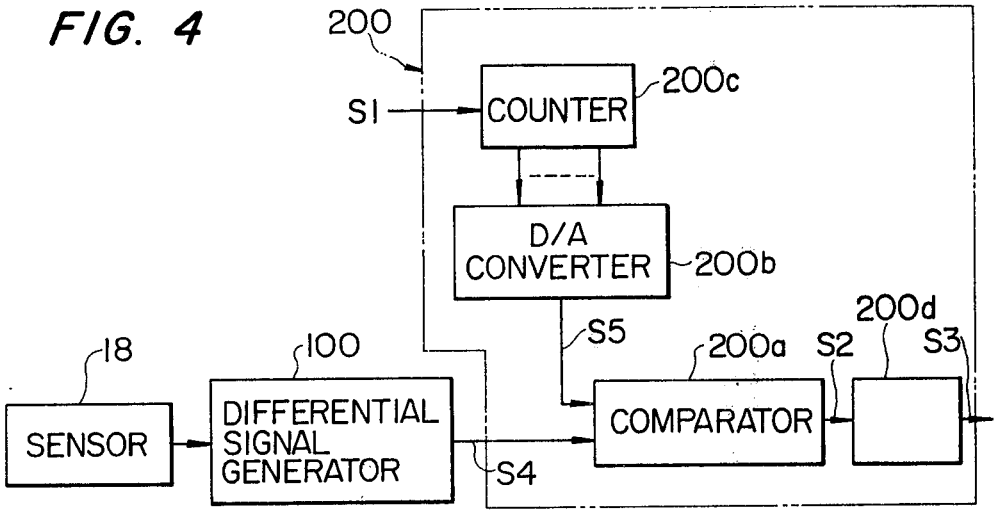
Figure 5:
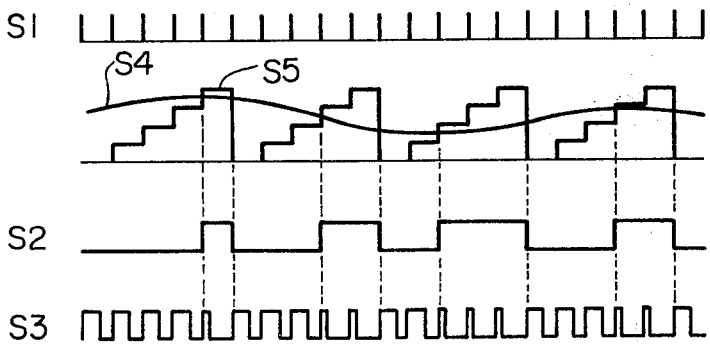
Figure 6:
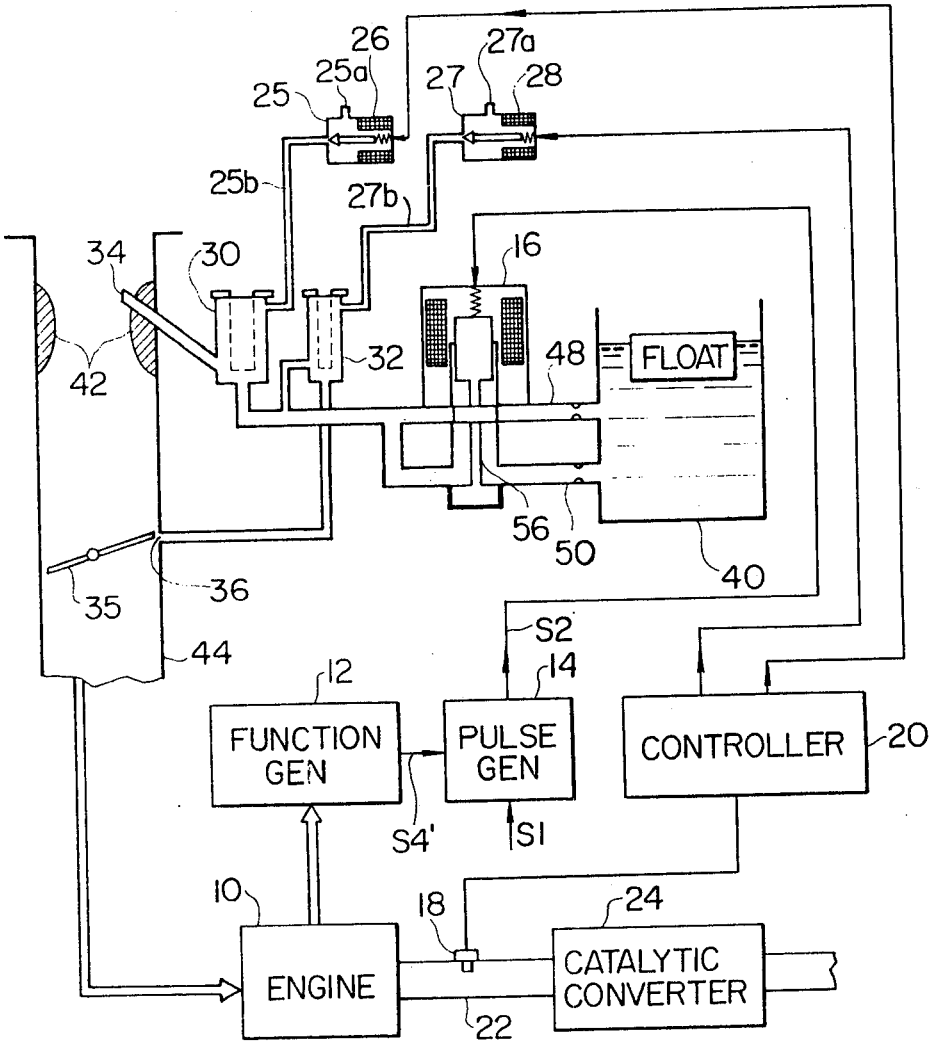
Figure 8A:
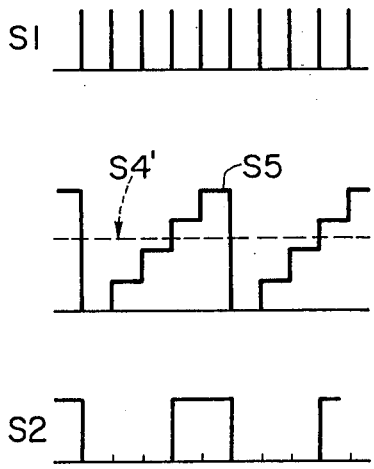
Figure 8B:
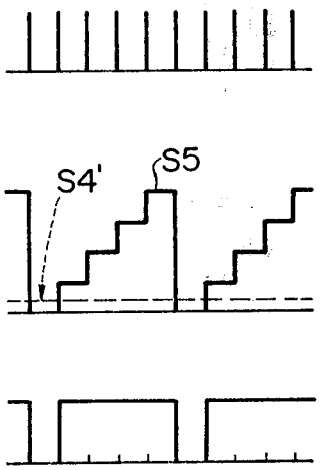
Figure 9:
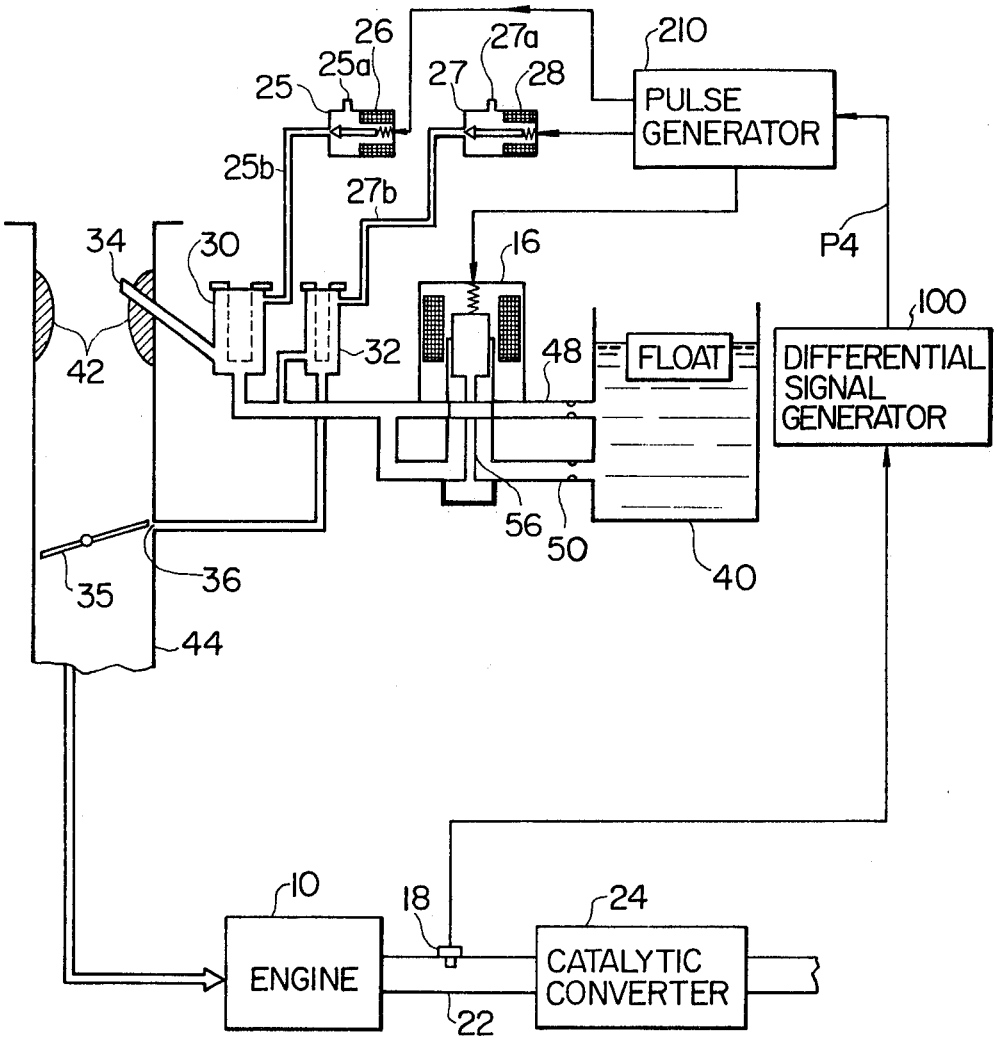

This and other objects, features and many of the attendant advantages of this invention will be appreciated more readily as the invention becomes better understood by the following detailed description, wherein like parts in each of the several FIGS. are identified by the same reference characters, and wherein:

FIG. 1 is a graph illustrating a concentration of oxides of nitrogen as a function of the air-fuel mixture;

FIG. 5 2*a* and 2*b* show various waveforms for interpretation of the basic concept of the present invention;

FIGS. 3 to 5 show a first preferred embodiment of the present invention;

FIGS. 6 to 8*b* show a second preferred embodiment of the present invention; and FIG. 9 shows a third preferred embodiment of the present invention.

Reference is now made to FIG. 1, wherein a curve is shown to illustrate a variation of concentration of oxides of nitrogen ($NO_x$) contained in exhaust gases from combustion chambers as a function of the air-fuel ratio of an air-fuel mixture. As is well known, carbon monoxide (CO) and hydrocarbons (HC) contained in exhaust gases are minimized in the vicinity of the stoichiometric air-fuel ratio. However, as shown in FIG. 1, the concentration of oxides of nitrogen has a peak value at about the stoichiometric air-fuel ratio (denoted by A) and has a lower value at the air-fuel ratio of the air-fuel mixture leaner or richer than stoichiometry. Reference characters B and C indicate limiting or critical values of the air-fuel ratio between which a stable operation of the engine is ensured. It is understood therefore that oxides of nitrogen can be considerably reduced in the vicinity of air-fuel ratio denoted by reference characters D or E. For this reason, there has been proposed an air-fuel ratio control system for effectively reducing oxides of nitrogen on the basis of the above-mentioned concept. In accordance with the control system of the prior art, a rich air-fuel mixture is supplied to a predetermined group of combustion chambers, and on the other hand, a lean air-fuel mixture is supplied to the other predetermined group of combustion chambers. In the above, the overall air-fuel ratio of the applied mixture can be set in average to the stoichiometric ratio in order to also effectively reduce both carbon monoxide and hydrocarbons. However, there are encountered some difficulties in the prior art system as pointed out below. That is, since each of the combustion chambers of one group is always supplied with either rich or lean air-fuel mixture, varying rates of carbonization occur in the associated exhaust manifolds and spark plugs, etc. As a result, durability of the cylinder and the spark plugs etc. is undesirably different. Furthermore miss firings due to carbonized spark plugs is inevitable.

The present invention is therefore connected with an improved air-fuel ratio control system for removing the above-mentioned difficulties. Briefly described, in accordance with the present invention a rich and a lean air-fuel mixture are alternatively supplied to each of the combustion chambers to obviate the aforementioned difficulties with effective reduction of oxides of nitrogen.

Prior to describing preferred embodiments of the present invention, the basic concept thereof is briefly set forth below in connection with FIGS. 2*a* and 2*b*. A signal S1 of pulsating form is generated in synchronism with, for example, ignition spark timing by a suitable pulse generating means. A signal S3 of a train of pulse is utilized to control the air-fuel ratio of an air-fuel mixture to be injected through the air-fuel injection valves to combustion chambers, in which a pulse having a wide width (depicted by reference characters M3, M4, and M5) serves to supply a rich mixture. On the other hand, a signal S2, which is generated in synchronism with the signal S1, is used to determine the pulse width of the signal S3 such that the signal S3 represents pulses each having a smaller width in the presence of a pulse of the signal S2 and whilst the signal S3 represents pulses each having a larger width in the absence of a pulse of the signal S2. In the above, the pulse width and the pulse spacing of the signal S2 is assumed to be constant for simplicity of illustration, however, in practice, they are varied in order to control the air-fuel ratio of an air-fuel mixture to be supplied in accordance with engine operating conditions as will be described later. As is seen from FIG. 2*a*, the ratio of rich to lean mixture is 3:2, so that five sequential conditions of a rich and a lean mixture are periodically supplied to the fuel injection valves. Therefore, assuming that an internal combustion engine has six combustion chambers or cylinders which are fired in a predetermined order, it is concluded that the combustion chambers are periodically supplied with a rich and a lean air-fuel mixture every 30 pulses of the signal S1. This is because the number of the combustion chambers and the number of the sequential conditions of a rich and a lean mixtures is in prime relationship with each other. In the above, the sequential order of the pulses (viz., M1-M2-M3-M4-M5) is not necessarily fixed. Any other sequential order is available as long as the ratio of rich to lean mixture is maintained at 3:2. The pulse width and the pulse spacing of the signal S2, as is previously mentioned, is varied in practice in order that the air-fuel ratio is set in average to a desirable value in accordance with engine operation mode.

From the foregoing, it is understood that each of the combustion chambers is alternatively supplied with a rich and a lean air-fuel mixture, so that the difficulties inherent in the prior art can be obviated.

As is previously described, in FIG. 2*a*, the signal S2 is generated in synchronism with the signal S1, however, this synchronous generation of the signal S2 is not necessarily required. In FIG. 2*b*, there are shown signals S2′ and S3′. The signal S2′ is generated in asynchronism with the signal S1 and the pulse width of the signal S3 is controlled by the signal S2′ in the same way as is already mentioned in connection with FIG. 2*a*. In this case, a period of alternative supply of a rich and a lean mixture to each of the combustion chambers is different from in the case of FIG. 2*a*, and is determined by the period of the signal S2′.

Reference is now made to FIG. 3 to 5, wherein there is illustrated a first embodiment of an air-fuel control system in accordance with the present invention. The control system in this embodiment is used with a fuel injection device, and the signal S2 in this embodiment is varied in accordance with an output signal of an exhaust gas sensor. As shown, a sensor 18, such as an oxygen analyzer, for sensing a component of exhaust gases is provided in an exhaust pipe 22 to be exposed to the exhaust gases emitted from an internal combustion engine 10, and the sensor 18 generates an electrical signal representative of the sensed component. The signal from the sensor 18 is then fed to a differential signal generator 100 which generates a signal S4 proportional to a differential value between the applied signal and a reference value. The reference value is so determined as to have an optimal value (stoichiometry, for example) to regulate the ratio of air to fuel of the air-fuel mixture to be supplied to the combustion chambers in order that, for example, noxious components such as carbon monoxide and hydrocarbons in exhaust gases are effectively reduced in a catalytic converter 24. It is to be noted that, in accordance with the present invention, oxides of nitrogen can be remarkably reduced so that it is sufficient to provide a catalytic converter for reducing carbon monoxide and hydrocarbons.

The signal S4 is then fed to a comparator 200*a* of a pulse generator 200. The pulse generator 200 includes a counter 200*c* to which the aforementioned signal S1 is applied. The counter 200*c*, in this embodiment, counts five pulses transferring them to a digital-to-analog (D/A) converter 200*b*, and then reverts to its initial condition and repeats the above counting operation. An output of the D/A converter 200*b* (a signal S5) is proportional to the number of the pulses applied thereto and is a stairstep voltage as shown. The signal S5 is then fed to the comparator 200a which compares the signal S5 with the signal S4 to generate the signal S2. The signal S2 is, as seen from FIG. 5, modulated in width by the comparing operation of the comparator 200*a*. Then, the signal S2 is fed to a control pulse generator 200*d* from which the signal S3 is generated. The pulse width of the signal S3 is determined in the same manner as mentioned in connection with FIG. 2*a*. The signal S3 is then fed to a fuel injection valves 111, 112, 113, 114, 115, and 116 (FIG. 3) to control the on/off operations thereof, wherein the pulse having a larger width corresponds to an injection of a rich air-fuel mixture, and on the other hand, the pulse having a smaller width corresponds to an injection of a lean air-fuel mixture.

In the foregoing, it should be noted that the number of pulses counted by the counter 200*c* is not limited to the five as long as the counted numbers are in prime relationship with the number of the combustion chambers or cylinders.

Figure 7:
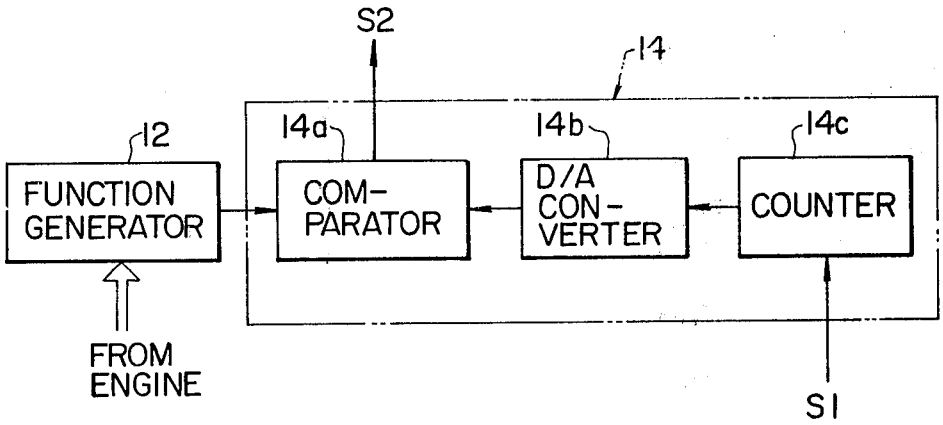

Reference is now made to FIGS. 6, 7, 8*a*, and 8*b*, wherein there is illustrated a second embodiment of an air-fuel control system in accordance with the present invention. The control system in this embodiment is used with a carburetor, and the signal S2 in this embodiment is varied in accordance with an output signal S4′ of a function generator 12. The signal S4′ from the function generator 12 depends upon various informations applied thereto: that is, the amount of opening of a throttle valve 35, intake vacuum pressure, engine speed, the amount of intaked air, temperature of cooling water, etc. The signal S4′ represents an optimal air-fuel ratio of the air-fuel mixture to be supplied to the combustion chambers in accordance with the engine operating conditions. The signal S4′ is then fed to a comparator 14a of a pulse generator 14 as shown in FIG. 7. The pulse generator 14 comprises the above-mentioned comparator 14*a*, a digital-to-analog converter 14*b*, and a counter 14*c*, which respectively correspond to the comparator 200*a*, the D/A converter 200*b*, and the counter 200*c* of the pulse generator 200 (FIG. 4). Therefore, detailed functions of the elements of the pulse generator 14 will not be described for clarity.

In this embodiment, when a rich air-fuel mixture is required, the signal S4′ takes a high value as indicated by a dotted line in FIG. 8*a* in order that pulse spacing of the signal S2 becomes wider. On the other hand, in the case of requirement of a lean air-fuel mixture, the signal S4′ takes a low value as indicated by a dotted line in FIG. 8*b* in order that pulse spacing of the signal S2 becomes narrower. The signal S2 is then fed to an electromagnetic valve 16 (FIG. 6) to control the air-fuel ratio by energizing or de-energizing the valve 16.

In the above, with respect to the relationship between rich or lean air-fuel mixture requirement and the value of the signal S4′, it should be noted that the high value of the signal S4′ can be determined to correspond to a rich mixture requirement and the low value of the signal S4′ to a lean mixture requirement.

Returning to FIG. 6, wherein the valve 16 is provided with a plunger 56 which is disposed in the respective fuel passageways 48 (for supplying a large amount of fuel) and 50 (for supplying a small amount of fuel) in such a manner that either one of the passageways 48 and 50 is blocked while the other is allowed to pass fuel from a float bowl 40 to air bleed chambers 30 and 32. The chambers 30 and 32 are respectively in communication with a main discharge nozzle 34 and an idle port 36. The main discharge nozzle 34 is provided at a venturi 42 of an induction pipe 44, and the idle port 36 is provided adjacent to the throttle valve 35. The air bleed chamber 30 has an air inlet port connected to an auxiliary air bleed chamber 25. On the other hand, the air bleed chamber 32 has an air inlet port connected to another auxiliary air bleed chamber 27. The auxiliary air bleed chambers 25 and 27 are respectively provided with electromagnetic valves 26 and 28 which control the amount of intaked air in accordance with pulses applied thereto from a controller 20. The passageways 48 and 50 have different diameters to permit fuel to be supplied at different rates so that a rich or a lean air-fuel mixture is selectively supplied to the combustion chambers in dependence on the movement of the plunger 56. Air is admitted through ports 25*a* and 27*a* of chambers 25 and 27, respectively, and through air bleed passageways 25*b* and 27*b* to the chambers 30 and 32, respectively, where fuel is admixed with the air to provide a rich or a lean air-fuel mixture.

In the above, the purpose of the controller 20 is for fine adjustment of the air-fuel ratio determined by the electromagnetic valve 16. The controller 20 is connected to the sensor 18 to receive an electrical signal representative of a sensed component therefrom. The controller 20 generates a train of pulses on the basis of the information from the sensor 18, which train of pulses is then fed to the valves 26 and 27 for the above-mentioned fine adjustment. The embodiment in question, however, is dispensable with the controller 20 and its associated elements.

Reference is now made to FIG. 9, wherein a third embodiment of an air-fuel control system in accordance with the present invention is illustrated. The third embodiment is similar to the second one except that all of the valves 26, 27 and 16 are under the control of a pulse generator 210. The pulse generator 210 is connected through the differential signal generator 100 to the sensor 18. The differential signal generator 100 is already interpreted in connection with FIGS. 3 and 4. On the other hand, the pulse generator 210 is similar to the pulse generator 200 (FIG. 4) except that the control pulse generator 200d is omitted in the former, so that further interpretation will not be made. It is understood that the third embodiment can also achieve the improved rich and lean air-fuel supply control as previously described in conjunction with the first and the second embodiments.

In the above, the differential signal generator 100 can be replaced by a suitable comparator.

It is apparent that various modifications may be made in the illustrated embodiments of the present invention within the intended scope of the invention as set forth in the hereinafter appended claims.

What is claimed is:

1. System for effectively reducing oxides of nitrogen in exhaust gases emitted from a plurality of sequentially operative combustion chambers of an internal combustion engine, which system comprises:

first means for generating a train of first pulses;

second means for receiving said first pulses to count and to group the same every predetermined number of said first pulses, said predetermined number of said first pulses being in a prime relationship with the number of said plurality of sequentially operative combustion chambers;

third means for generating a control signal indicative of an optimal air-fuel mixture to be supplied to the combustion chambers according to engine operating conditions;

fourth means for reeiving both said control signal from said third means and said first pulses from said second means to generate a train of second pulses, each of said second pulses being generated within a time duration of said predetermined number of said first pulses in such a manner as to be modulated in width in dependence of said control signal;

fifth means for controlling a fuel supply to the combustion chambers, which receives the train of said second pulses to alternatively supply a rich and a lean air-fuel mixture to each of the combustion chambers according to each of said second pulses.

2. System claimed in claim 1, wherein said second means receives said first pulses to convert the same into third signal, the magnitude of said third signal being proportional to the number of said first pulses applied thereto and the period thereof being determined by said predetermined number of said first pulses applied thereto, and said fourth means comparing said control signal with said third signal to generate a train of said second pulses each of which is modulated in width.

3. System claimed in claim 1, wherein said first pulses are generated in synchronism with the rotation of said internal combustion engine.

4. System claimed in claim 1, wherein said first pulses are generated in synchronism with the rotation of said internal combustion engine.

5. System claimed in claim 1, wherein said third means is a function generator which receives a signal indicative of engine operating conditions to generate said control signal.

6. System claimed in claim 1, wherein said third means comprises:

a sensor for sensing a concentration of a constituent of exhaust gases and generating a signal representative thereof;

a differential generator being connected to said sensor and generating said control signal representative of the differential value between said signal from said sensor and a reference signal, the magnitude of said reference signal being varied according to a demanded engine operation.

7. System claimed in claim 1, wherein said fifth means is an electrically controlled fuel injection control means.

8. System claimed in claim 1, wherein said fifth means is a carburetor type fuel supply means which comprises:

an air bleed passage;

a fuel supply passage;

air fuel mixture means in communication with said air bleed passage and said fuel supply passage;

at least one electromagnetic valve being disposed in said air bleed passage to control the amount of air to be mixed with the fuel in response to said second pulses; and an electromagnetic valve being disposed in said fuel supply passage to control the amount of fuel to be mixed with the air in response to said second pulses.

9. System claimed in claim 1, wherein said fifth means is a carburetor type fuel supply means which comprises:

an air bleed passage;

a fuel supply passage;

air fuel mixture means in communication with said air bleed passage and said fuel supply passage;

at least one electromagnetic valve being disposed in said air bleed passage to control the amount of air to be mixed with the fuel in response to said second pulses.

* * * * *